US005115753A

United States Patent [19]

Craddock

[11] Patent Number: 5,115,753

[45] Date of Patent: May 26, 1992

[54] FLOATING BOAT LIFT

[76] Inventor: Gary D. Craddock, 4942 Commonwealth Dr., Sarasota, Fla. 34242

[21] Appl. No.: 713,054

[22] Filed: Jun. 10, 1991

[51] Int. Cl.[5] ..... B63C 1/02

[52] U.S. Cl. ..... 114/48

[58] Field of Search ..... 114/44–48; 405/3, 4, 7

[56] References Cited

U.S. PATENT DOCUMENTS

| | | | |
|---|---|---|---|
| 3,603,276 | 9/1971 | DeLisle | 114/85 |
| 4,381,723 | 5/1983 | Furst | 405/3 |
| 4,750,444 | 6/1988 | Lemvig | 114/45 |
| 4,955,308 | 9/1990 | Craddock | 114/45 |

*Primary Examiner*—Jesus D. Sotelo
*Attorney, Agent, or Firm*—Charles J. Prescott

[57] ABSTRACT

A floating boat lift for lifting and supporting a boat above the surface of a body of water. The device includes a lower pontoon base and two elongated upper pontoons positioned above the lower pontoon base and held spaced apart and generally parallel one to another by a rigid frame connected therebetween. The upper pontoons are laterally restrained and are controlledly movable vertically with respect to the lower pontoon base by a vertical actuator arrangement. The upper pontoons may be filled or emptied of water. When empty, the actuator arrangement extends in length so as to lift the upper pontoons from the water. A boat placed atop the frame is also lifted and held above the water as the upper pontoons are drained. When the upper pontoons are filled with water, the actuator arrangement compresses in length and the lower pontoon base submerges until the lower portions of the upper pontoons become submerged, at which point the boat may be floated onto or removed from the submerged frame. The device is fully self-buoyant during all aspects of use.

3 Claims, 1 Drawing Sheet

FLOATING BOAT LIFT

BACKGROUND OF THE INVENTION

This invention relates generally to floating boat lifts, and more particularly to a floating boat lift which utilizes water-fillable upper pontoons to affect loading and unloading of a boat to and from the device.

Other devices are known to applicant which utilize pontoons in conjunction with a boat lift device. Applicant is the inventor of U.S. Pat. No. 4,955,308 which is directed to a boat lift having two spaced pontoons and cable-actuated cradle which travels arcuately on support arms.

Another patented device is disclosed in U.S. Pat. No. 4,018,179 to Rutter which teaches a pontoon system having two pairs of pontoons, one pair of which is fillable with water for submersion and elevation of a central cradle portion of this device.

Applicant is also aware of the following additional U.S. patents which are directed to pontoons with fillable chambers and having a fixed interrelationship between components:

| | |
|---|---|
| 1,486,257 | Muller |
| 1,486,258 | Muller |
| 2,894,472 | Foster |
| 3,976,022 | Lapeyre |
| 4,267,788 | Blanco |
| 2,834,311 | Engstrand |
| 4,273,061 | Lundberg |
| 4,510,877 | Bloxham |
| 4,615,289 | Bloxham |

The present invention discloses a floating boat lift which includes a unique arrangement of spaced upper pontoons held above, and made vertically movable with respect to, a lower pontoon base. The upper pontoons are fillable with water so as to facilitate loading and unloading of the boat atop a rigid frame connected between the upper pontoons.

BRIEF SUMMARY OF THE INVENTION

This invention is directed to a floating boat lift for lifting and supporting a boat above the surface of a body of water. The device includes a lower pontoon base and two elongated upper pontoons positioned above the lower pontoon base and held spaced apart and generally parallel one to another by a rigid frame connected therebetween. The upper pontoons are laterally restrained and are controlledly movable vertically with respect to the lower pontoon base by a vertical actuator arrangement. The upper pontoons may be filled or emptied of water. When empty, the actuator arrangement extends in length so as to lift the upper pontoons from the water. A boat placed atop the frame is also lifted and held above the water as the upper pontoons are drained. When the upper pontoons are filled with water, the actuator arrangement compresses in length and the lower pontoon base submerges until the lower portions of the upper pontoons become submerged, at which point the boat may be floated onto or removed from the submerged frame. The device is self-buoyant during all aspects of use.

It is therefore an object of this invention to provide a floating boat lift for lifting and holding a boat out of the water when not in use.

It is another object of this invention to provide a floating boat lift which does not require an additional power supply or moving motor components to effect full actuation.

It is yet another object of this invention to provide a floating boat lift which minimizes the depth of water required to operate and to lift and store a boat above the surface of the water.

In accordance with these and other objects which will become apparent hereinafter, the instant invention will now be described with reference to the accompanying drawings.

DETAILED DESCRIPTION OF THE INVENTION

Figure 1:
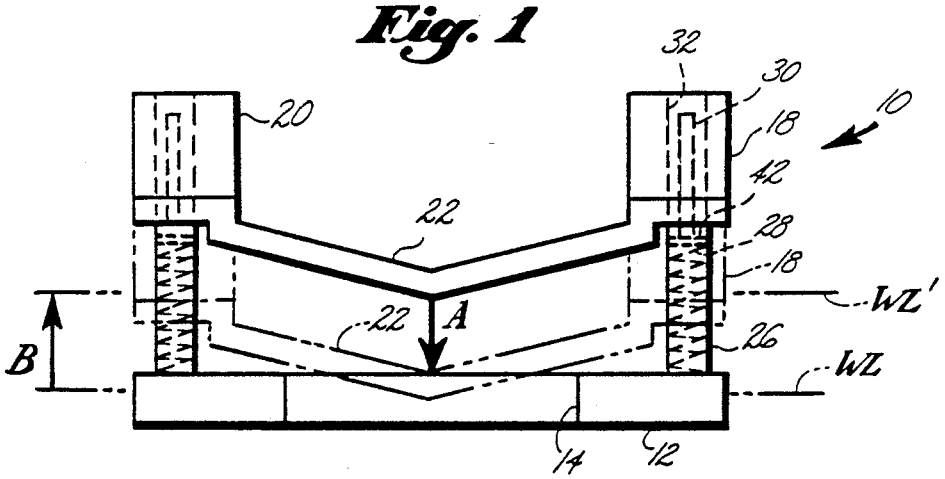
FIG. 1 is an end elevation schematic view of the invention in the direction of arrows 1—1 in FIG. 2.
Figure 2:
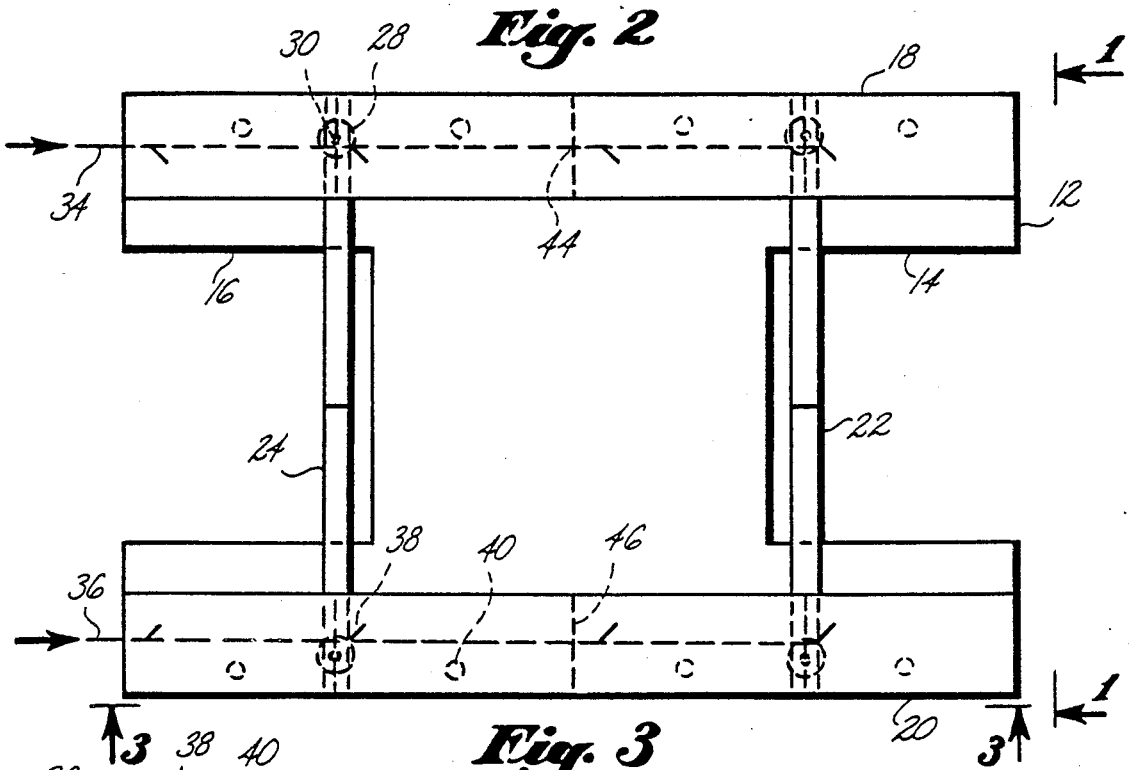
FIG. 2 is a top plan schematic view of the invention.

Referring now to the drawings, the invention is shown generally at numeral 10 and includes a lower pontoon base 12 and a pair of spaced apart elongated upper pontoons 18 and 20 which are generally coextensive with the lower pontoon base 12. The upper pontoons 18 and 20 are rigidly connected together by two spaced frames or cradles 22 and 24 which are generally V-shaped as shown in FIG. 1 to receive and supportively mate against the hull of a boat.

The lower pontoon base 12 is somewhat H-shaped having cut outs 14 and 16 which facilitate loading and unloading of the boat atop frames 22 and 24 without interfering with underwater propulsion gear of the boat.

The upper pontoons 18 and 20 are held for controlled vertical movement only above the lower pontoon base 12 by a plurality of confined elongated spring actuator mechanisms which each include a tubular housing 26 rigidly connected to the lower pontoon base, a coil compression spring 28 mounted within housing 26, and a guide or shaft 30 which is rigidly connected at its upper end within each upper pontoon 18 and 20 as shown. An enlarged spring seat 42 is connected at the lower end of shaft 30 which acts upon the upper end of coil spring 28. By this arrangement, the compressive force of each coil spring 28 upwardly acts from lower pontoon base 12 to support the upper pontoons 18 and 20 and frames 22 and 24. By confining the coil springs 28 within housing 26, which itself slidably translates within cavity 32, lateral alignment and stability between the upper pontoons 18 and 20 and pontoon base 12 is maintained.

Each upper pontoon 18 and 20 is provided with a water inlet 34 and 36 which each introduce water into pontoons 18 and 20, respectively through nozzles 38. This arrangement allows for the controlled filling of each pontoon 18 and 20. Separately, drains 40 provided in the bottom surface of each upper pontoon 18 and 20 which controlledly allow the water to be drained from each upper pontoon.

In operation, when the upper pontoons 18 and 20 are empty of water, the lower pontoon base 12 is partially submerged at water line WL so as to buoyantly support the entire device 10 as shown in solid in FIG. 1. In this configuration, the coil springs 28 are fully extended to the limits of the actuator arrangements and so that the pontoons 18 and 20 and frames 22 and 24 are held above the water line WL.

Figure 3:
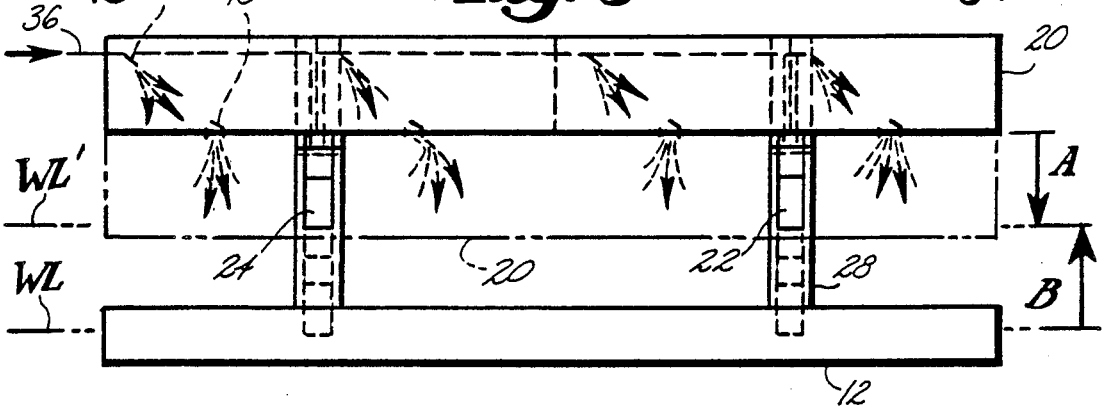
FIG. 3 is a side elevation schematic view of the invention in the direction of arrows 3—3 in FIG. 2.

When the upper pontoons 18 and 20 are filled with water, the coil springs 28 are overcome and the frames 22 and 24 and upper pontoons 18 and 20 move downwardly a maximum distance in the direction of arrow A shown in phantom in FIGS. 1 and 3. The additional weight of the water within upper pontoons 18 and 20 will result in further submersion of the lower pontoon base 12 so that the water line WL now relocate upwardly (in effect) in the direction of arrow B to WL'. In the preferred embodiment, the upper pontoons 18 and 20, when filled and in the position shown in phantom, become partially submerged at the bottom to contribute to the overall buoyancy of the arrangement 10.

When the upper pontoons 18 and 20 are filled with water and in the position shown in phantom in FIGS. 1 and 3, a boat may be floated atop frames 22 and 24 between pontoons 18 and 20 in unobstructed fashion. When so positioned, the drains 40 are then opened to allow the water within upper pontoons 18 and 20 to be released. As this water is released, the upper pontoons 18 and 20, being reduced in weight, are then moved upwardly by the force of the coil springs 28 to their fully upwardly position as shown in solid in FIGS. 1 and 3.

Because the weight of water containable within upper pontoons 18 and 20 is substantially larger than the weight of a boat intended to be lifted and stored on frames 22 and 24 for each particular size configuration of the device 10, the levels of buoyancy are such that the entire arrangement, either with or without a boat atop frames 22 and 24, will function in response to water intake and discharge from upper pontoons 18 and 20 as is above described. That is, the filling of upper pontoons 18 and 20 will move the frames 22 and 24 downwardly in the direction of arrow A so that the water line moves in the direction of arrow B from WL to WL' and in a reverse manner, regardless of whether a boat is resting atop frames 22 and 24.

The preferred embodiment of the vertical actuators is as above described in the form of confined coil springs 28. This arrangement is chosen so as to eliminate the need for lifting or pumping motors and an auxiliary power supply are required, except for a pressurized water supply for pumping water into the upper pontoons 18 and 20. Moreover, it would be fully within the scope of this invention to provide alternate vertical actuator means in the form of pneumatic or hydraulic cylinders or other similar controlled axial force-generating devices which may require auxiliary power supplies for their actuation in a manner similar to that previously described with respect to the preferred embodiment of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A floating boat lift for lifting and supporting a boat above the surface of a body of water comprising:

a lower pontoon base;

two elongated upper pontoons positioned above said lower pontoon base, said upper pontoons held spaced apart generally parallel one to another by a rigid frame connected there between;

each said upper pontoon connected to a water supply whereby each of said upper pontoons may be controlledly filled with water;

each said upper pontoon including means for controlledly draining water therefrom;

a compressible vertical actuator means connected between said upper pontoons and said lower pontoon base for maintaining lateral alignment of said upper pontoons above said lower pontoon base;

said actuator means also for fully extending in length vertically, lifting said upper pontoons and said frame out of the water when said upper pontoons are empty of water;

said actuator means also for fully compressing in length vertically whereby said frame and a portion of said upper pontoons are submerged when said upper pontoons are filled with water;

said lower pontoon base sized and of sufficient floatation to support a boat on said frame substantially above the water when said upper pontoons are empty of water.

2. A floating boat lift for lifting and supporting a boat above the surface of a body of water as set forth in claim 1, wherein:

said lower pontoon base is generally "H" shaped in plan view to provide clearance for propulsion gear of the boat as the boat is floated over said frame when said actuator means is substantially compressed in length.

3. A floating boat lift for lifting and supporting a boat above the surface of a body of water as set forth in claim 1, wherein:

said actuator means is a plurality of compression springs, each spring of said plurality of springs mounted in a vertical guide and acted upon in compression between said lower pontoon base and an upper spring plate movable within each said guide and connected to one said pontoon.

* * * * *